US009100993B2

(12) United States Patent
Makino

(10) Patent No.: US 9,100,993 B2
(45) Date of Patent: Aug. 4, 2015

(54) HEATING DEVICES AND FUEL VAPOR PROCESSING APPARATUS USING THE HEATING DEVICES

(75) Inventor: Katsuhiko Makino, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 514 days.

(21) Appl. No.: 13/528,912

(22) Filed: Jun. 21, 2012

(65) Prior Publication Data

US 2012/0325798 A1 Dec. 27, 2012

(30) Foreign Application Priority Data

Jun. 23, 2011 (JP) ..... 2011-139222

(51) Int. Cl.
*F27D 11/00* (2006.01)
*H05B 3/28* (2006.01)

(52) U.S. Cl.
CPC ..... *H05B 3/286* (2013.01); *H05B 2203/024* (2013.01)

(58) Field of Classification Search
CPC ..... H05B 3/48; H05B 3/36; H05B 3/30; H05B 3/286; H05B 3/283; H05B 3/28; H05B 3/26; H05B 3/262; H05B 3/267; H05B 3/265; H05B 3/50; H05B 3/00; H05B 3/14; H05B 2203/024; H05B 2203/02; H01C 1/014; H01C 7/02; H05K 1/0212; H05K 1/18; H05K 1/066
See application file for complete search history.

(56) References Cited

U.S. PATENT DOCUMENTS

2006/0289464 A1 12/2006 Von der Luhe et al.

FOREIGN PATENT DOCUMENTS

| | | | |
|---|---|---|---|
| JP | 3-201386 | * | 9/1991 |
| JP | 3-201386 | A | 9/1991 |
| JP | 07-022162 | | 1/1995 |
| JP | 9-212016 | A | 8/1997 |
| JP | 2000-082571 | | 3/2000 |
| JP | 2001-351764 | A | 12/2001 |
| JP | 2009-156030 | | 7/2009 |

OTHER PUBLICATIONS

Japanese Office Action mailed Jul. 1, 2014, corresponding to Japanese Patent Application 2011-139222; with English Translation attached.

* cited by examiner

*Primary Examiner* — Shawntina Fuqua
(74) *Attorney, Agent, or Firm* — Ladas & Parry LLP

(57) ABSTRACT

A heating device may include an electric heating element configured to generate heat, a heat radiation element, and an electrical insulation member interposed between the electric heating element and the heat radiation element. The electrical insulation member may be bonded to both of the electric heating element and the heat radiation element.

20 Claims, 12 Drawing Sheets

HEATING DEVICES AND FUEL VAPOR PROCESSING APPARATUS USING THE HEATING DEVICES

This application claims priority to Japanese patent application serial number 2011-139222, the contents of which are incorporated herein by reference.

BACKGROUND OF THE INVENTION

1. Field of the Invention

Embodiments of the present invention relate to heating devices and fuel vapor processing apparatus using the heating devices.

2. Description of the Related Art

JP-A-2009-156030 teaches a known heating device used for a fuel vapor processing apparatus. The heating device disclosed in this document includes a PTC unit and a pair of heat radiation plates disposed at opposite surfaces of the heating unit. The PTC unit includes a sheet-like PTC ceramic material with polyimide films provided as insulation layers on opposite surfaces of the PCT ceramic material. The PTC ceramic material may generate heat by receiving a supply of an electric power. The PTC unit is clamped between the pair of heat radiation plates by crimping the heat radiation plates together in a state that the PTC unit is positioned therebetween.

In the known heating device, the heat radiation plates are brought to contact the polyimide films of the PTC unit as the heat radiation plates are crimped. However, the hat radiation plates are not adhered or bonded to the polyimide films. Therefore, it may be possible that the polyimide films and the heat radiation plates do not closely contact with each other to cause loss of heat conducted from the PTC ceramic material to the heat radiation plates via the polyimide films. This may result in low heat conductivity from the PTC unit to the heat radiation plates. To this end, the polyimide films and the corresponding heat radiation plates may be joined together by using a special adhesive material. However, in such a case, the manufacturing cost may be increased due to the use of the special adhesive material.

Therefore, there has been a need in the art for an improved technique of reducing loss of heat conducted from a heating element to heat radiation plates via insulation layers of the heating element.

SUMMARY OF THE INVENTION

In one aspect according to the present teachings, a heating device may include an electric heating element configured to generate heat, a heat radiation element, and an electrical insulation member interposed between the electric heating element and the heat radiation element. The electrical insulation member may be bonded to both of the electric heating element and the heat radiation element.

DETAILED DESCRIPTION OF THE INVENTION

Figure 1:
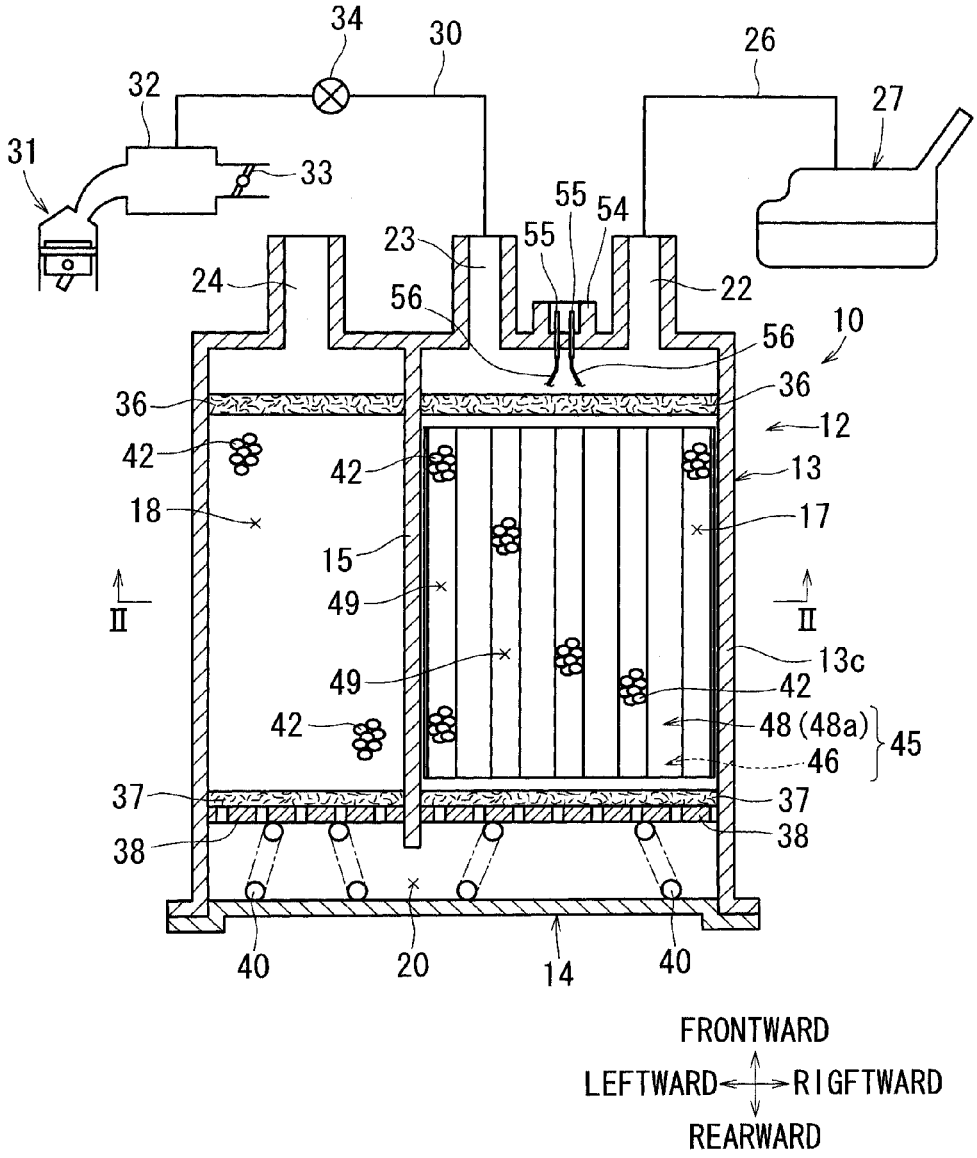
FIG. 1 is a horizontal sectional view of a fuel vapor processing apparatus including a heating device according to a first embodiment.

Each of the additional features and teachings disclosed above and below may be utilized separately or in conjunction with other features and teachings to provide improved heating devices and fuel vapor processing apparatus incorporating such heating devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a heating device may include a heat generation unit including a heat generation element, a first insulation layer and a second insulation layer. The heat generation element has a first surface and a second surface opposite to the first surface and can generate heat by receiving a supply of an electric power. The first insulation layer and the second insulation layer are disposed at the first surface and the second surface of the heat generation element, respectively. The heat generation unit has a first side on the side of the first surface of the heat generation element and has a second side and on the side of the second surface of the heat generation element. A first heat radiation element may be disposed on the first side of the heat generation unit, so that the first insulation layer is positioned between the heat generation element and the first heat radiation element. The first insulation layer may provide insulative protection of the heat generation element and may be bonded to both of the heat generation element and the first heat radiation element.

Because the first insulation layer may be bonded to both of the heat generation element and the first heat radiation element, the heat generation element and the first heat radiation element can be positioned close to each other via the first insulation layer. Hence, it is possible to reduce loss of heat conducted from the heating element to the first heat radiation element via the first insulation layer, so that the heat of the heating element can be efficiently conducted to the first heat radiation element. No special adhesive material is necessary to be used. Therefore, it is possible to simplify the process of insulating between the heating element and the first heat radiation element and bonding them together. As a result, it is possible to reduce the manufacturing cost of the heating device.

The heating device may further include a second heat radiation element positioned on the second side of the heat generation unit, so that the second insulation layer is positioned between the heat generation element and the second heat radiation element. The second insulation layer may provide insulative protection of the heat generation element and may be bonded to both of the heat generation element and the second heat radiation element.

The heat generation element may be formed of a printed layer. Because the printed layer is thin, the heat generation element may naturally have a thin thickness. In addition, it is possible to position the first heat insulation layer further closely to the first heat radiation element and/or to position the second heat insulation layer further closely to the second heat radiation element. Hence, it is possible to further improve the heat conductivity from the heating element to the heat radiation element(s).

Each of the first and second heat insulation layers may also be formed of a printed layer. Because the printed layer is thin, each of the first and second heat insulation layers may naturally have a thin thickness. Therefore, it is possible to further improve the heat conductivity from the heating element to the heat radiation element(s).

The first heat radiation element and/or the second heat radiation element may have a honeycomb structure. The honeycomb structure may provide a large heat radiation area, so that it is possible to further improve the conductivity of heat from the heat generation element to the heat radiation element (s).

The first heat radiation element and/or the second heat radiation element having the honeycomb structure may include a plurality of metal foils stacked in a layered direction to form a layered structure. The plurality of metal foils are joined to each other at joint portions, the joint portions extend parallel to each other at an interval and are arranged in a staggered pattern along the layered direction. The layered structure may be unfolded in the layered direction to have a predetermined shape. The first heat radiation element (and/or the second heat radiation element) may be bonded to the heat generation element via the first insulation layer (and/or the second heat radiation element) in the state that the layered structure is not unfolded into the predetermined shape.

Because the metal foil may have a thin thickness, the first heat radiation element and/or the second heat radiation element may be lightweight. In addition, because the first heat radiation element (and/or the second heat radiation element) may be bonded to the heat generation element via the first insulation layer (and/or the second heat radiation element) in the state that the layered structure is not unfolded into the predetermined shape, the first heat radiation element (and/or the second heat radiation element) can be easily handled both before and after bonding to the heat generation element. Thus, before bonding to the heat generation element, the heat radiation element(s) may be handled in the folded state. The heat generation element may be unfolded in the layered direction to have the predetermined shape when the heating device is necessary to be used.

In another embodiment, a fuel vapor processing apparatus may have the heating device configured as in the above embodiment and may further include a case defining therein an adsorption chamber. An adsorption material capable of adsorbing fuel vapor may be disposed within the adsorption chamber. The case may be configured to be able to introduce air into the adsorption chamber for desorbing fuel vapor from the adsorption material. The heating device may be positioned within the adsorption chamber.

Because the heat of the heating element can be efficiently conducted to the heating device and further to the adsorption material, it is possible to effectively heat the adsorption material during desorption of fuel vapor from the adsorption material. Therefore, it is possible to effectively prevent decrease in temperature of the adsorption material, so that desorption efficiency of fuel vapor can be improved. In the case that the first heat radiation element (and/or the second heat radiation element) is designed to allow passage of gas in a specific direction, the heat radiation element(s) may be oriented within the adsorption chamber such that the specific direction coincides with the direction of flow of gas through the adsorption chamber.

Figure 2:
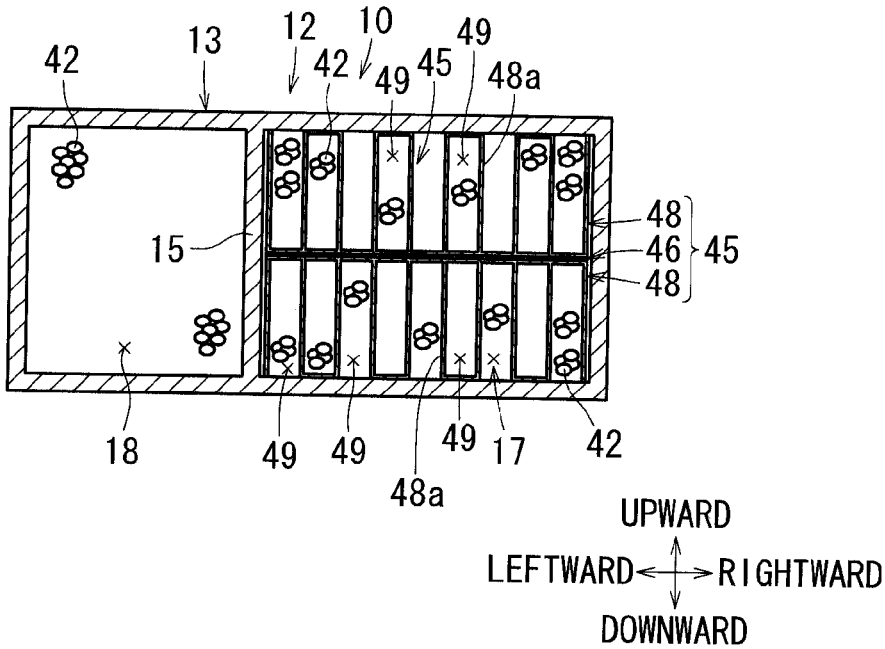
FIG. 2 is a sectional view taken along line II-II in FIG. 1.

A first embodiment will now be described with reference to FIGS. 1 and 2. Referring to FIGS. 1 and 2, there is shown a fuel vapor processing apparatus 10 that may be called as a canister and can be installed on a vehicle, such as an automobile. For the purpose of explanation, an upper side, a lower side, a left side and a right side of the apparatus are determined on the basis of a horizontal sectional view of the fuel vapor processing apparatus 10 shown in FIG. 1 (see arrows in FIG. 1).

As shown in FIGS. 1 and 2, the fuel vapor processing apparatus 10 may include a case 12 having a rectangular box shape. The case 12 may be made of resin and may include a case body 13 and a closure member 14. The case body 13 has a rectangular parallelepiped shape and includes a closed front end (upper end as viewed in FIG. 1) and an open rear end (lower end as viewed in FIG. 1). The closure member 14 closes the open rear end of the case body 13. A partition wall 15 may be formed within the case body 13, so that the space within the case body 13 may be separated into right and left chambers by the partition wall 15. A primary adsorption chamber 17 and a secondary adsorption chamber 18 are defined in the right chamber and the left chamber of the case body 13, respectively, and communicate with each other via a communication passage 20 formed between the case body 13 and the closure member 14.

A tank port 22, a purge port 23 and an atmospheric port 24 may be formed on the front end wall of the case body 13. The tank port 22 and the purge port 23 communicate with the primary adsorption chamber 17 of the case body 13. The atmospheric port 24 communicates with the secondary adsorption chamber 18 of the case body 13. The tank port 22 may communicate with a gaseous phase space (not shown) formed in a fuel tank 27 via a fuel vapor passage 26. The purge port 23 may communicate with an intake pipe 32 of an internal combustion engine 31 via a purge passage 30. A throttle valve 33 may be disposed within the intake pipe 32 for controlling the amount of intake air. The purge passage 30 communicates with the intake pipe 32 at a position on the downstream side of the throttle valve 33. A purge valve 34 may be disposed in the midway of the purge passage 30. A vehicle engine control unit (ECU) (not shown) may control the purge valve 34 for opening and closing the same. The atmospheric port 24 may be opened to the atmosphere.

Front filters 36 may be disposed at the front end portions of the primary adsorption chamber 17 and the secondary adsorption chamber 18. Rear filters 37 may be disposed at the rear end portions of the primary adsorption chamber 17 and the secondary adsorption chamber 18. Each of the front and rear filters 36 and 37 may be made of non-woven resin fabric, urethane foam or any other suitable material. Perforated plates 38 may be disposed on the rear side of the rear filters 37 of the primary and secondary adsorption chambers 17 and 18 so as to be overlapped with the respective rear filters 37. A spring 40 may be interposed between the closure member 14 and each of the perforated plates 38. The spring 40 may be a coil spring.

A granular adsorption material 42 may be filled into each of the primary adsorption chamber 17 and the secondary adsorption chamber 18 (more specifically, between the front filter 36 and the rear filter 37 of each adsorption chamber). Activated carbon granules may be used as the granular adsorption material 42. The activated carbon granules may be pulverized activated carbon or may be granulated or palletized activated carbon formed from a mixture of activated carbon powder and a binder.

A heating device 45 may be inserted into the primary adsorption chamber 17 prior to filling the adsorption material 42. The heating device 45 will now be described with reference to FIGS. 3 and 4. For the purpose of explanation, directions for the heating device 45 are determined to correspond to the directions for the fuel vapor processing apparatus 10.

Figure 3:
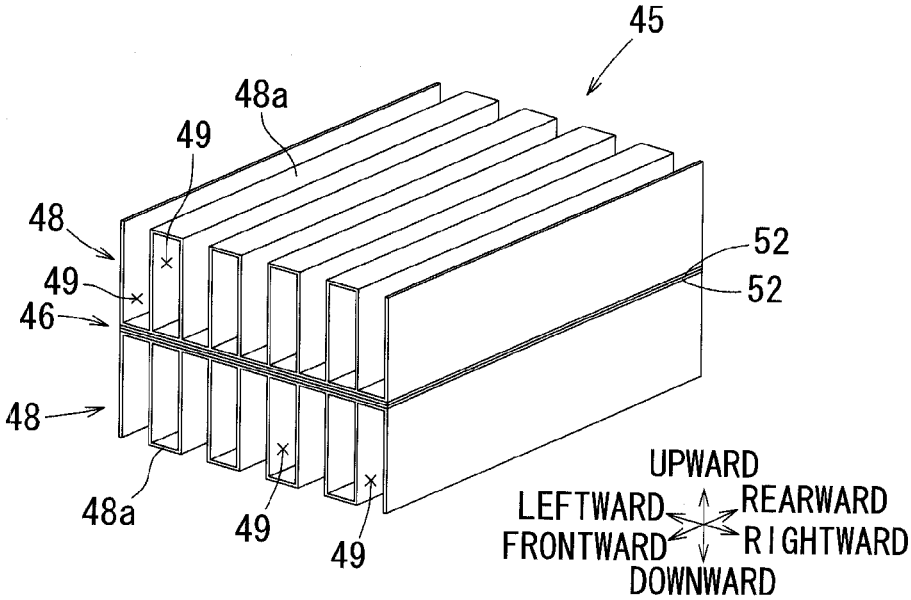
FIG. 3 is a perspective view of the heating device of the first embodiment.

Referring to FIG. 3, the heating device 45 may include a sheet-like heat generation unit 46 and a pair of upper and lower heat radiating members 48 bonded to the upper and lower surfaces of the heat generation unit 46.

Figure 4:
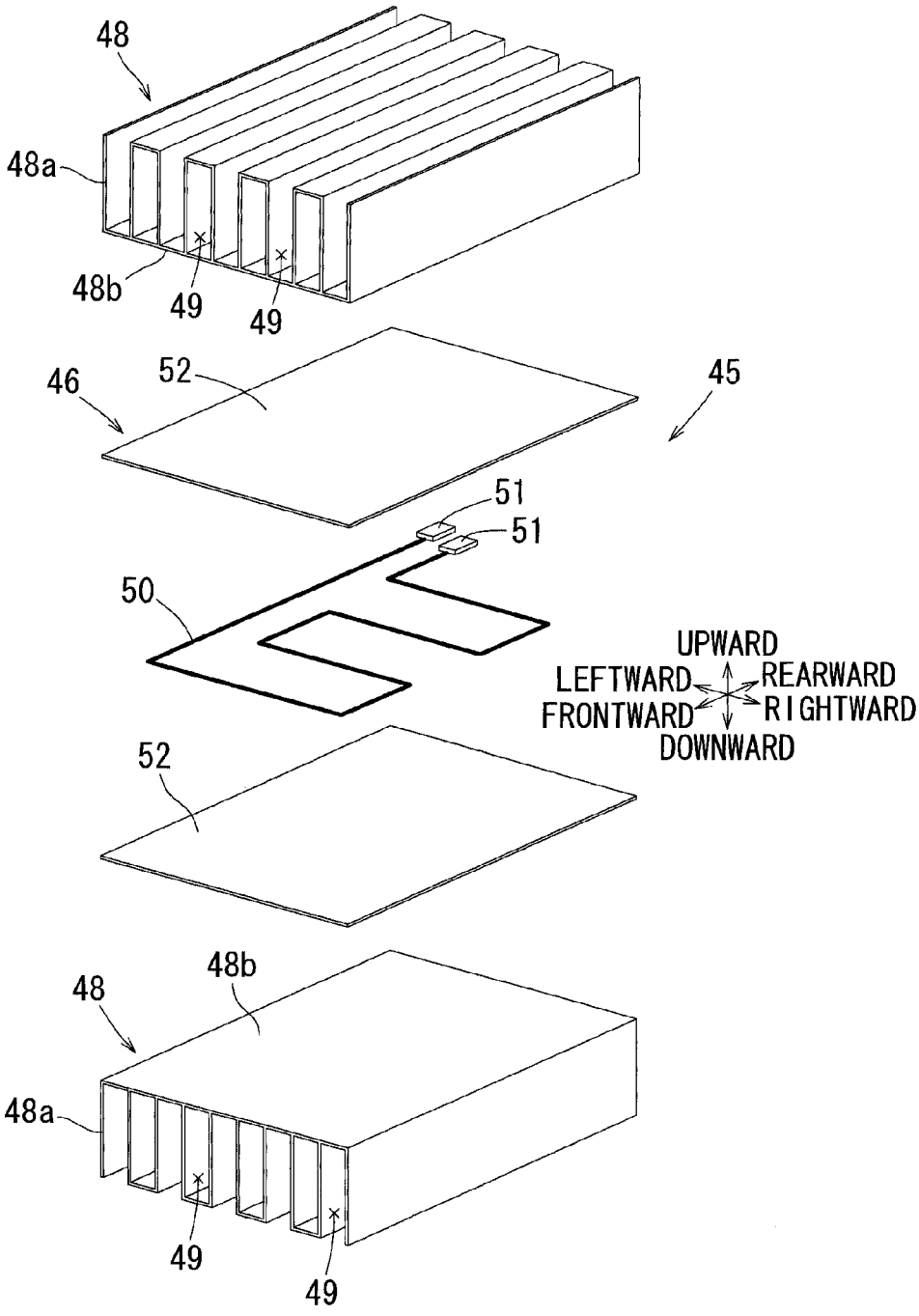
FIG. 4 is an exploded perspective view of the heating device of the first embodiment.

As shown in FIG. 4, the heat generation unit 46 includes a heat generation element 50 that may generate heat by receiving a supply of an electric power, and a pair of upper and lower insulation films 52 for holding the heat generation element 50 such that the upper and lower insulation films 52 overlap with the heat generation element 50 from opposite sides. The upper and lower insulation films 52 may be made of a material having an electrical insulation property and may serve as insulation layers. The heat generation element 50 may be made of a metal foil, a nichrome wire or any other suitable material and may be formed to have a shape meandering within a flat plane. The opposite ends of the heat generation element 50 may extend parallel to each other and may be oriented rearward toward the outside of the heat generation unit 46. A terminal 51 may be connected to each of opposite ends of the heat generation element 50. Each of the insulation films 52 has a function of insulating and protecting the heat generation element 50 and also has a function of bonding the heat generation element 50 and the corresponding heat radiation element 48 to each other. Further, the insulation films 52 have a function of bonding the insulation films 52 themselves together. Each of the insulation films 52 may be made of a thermoplastic resin film, such as a polyimide film. The thickness of each insulation film 52 may be about 10 to 30 μm.

The heat radiating members 48 are arranged symmetrically with each other in the vertical direction with the heat generation unit 46 positioned therebetween and serve to radiate heat, which is generated by the heat generation unit 36, to the outside of the heat generation unit 36. Each of the heat radiating members 48 may be made of a material, such as aluminum alloy, having a thermal conductivity higher than that of the adsorption material 42. Each of the heat radiating members 48 may include a plate fin 48*a* as a main component. The plate fin 48*a* may have a rectangular cross section and may be configured as a corrugated plate extending in the forward and rearward direction. A flat mount plate portion 48*b* may be formed on the plate fin 48*a* at a position one side of the plate fin 48*a* facing to the heat generation unit 46. A plurality of parallel gas passages 49 may be formed in the plate fin 48*a* and may extend in the forward and rearward direction. Each of the heat radiation elements 48 (more specifically, the mount plate portions 48*b*) and the heat generation element 50 of the heat generation unit 46 may be entirely bonded together by the corresponding insulation film 52 interposed therebetween (see FIG. 3). In this way, the heat generation unit 46 and the heat radiating members 48 are integrated to constitute the heating device 45.

Figure 5:
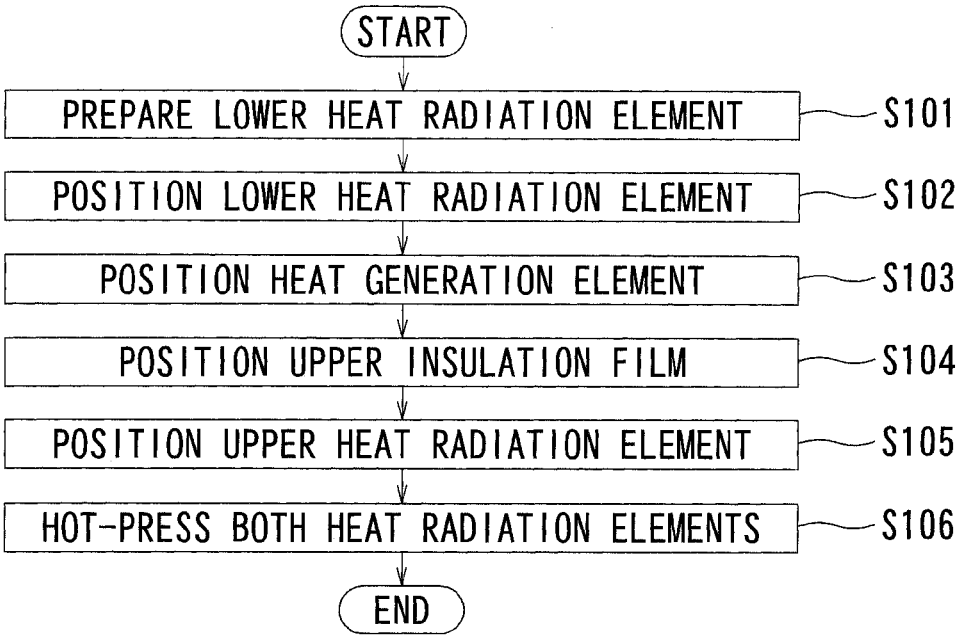
FIG. 5 is a flow chart showing a manufacturing process of the heating device of the first embodiment.

A representative example of a method of manufacturing the heating device 45 will now be described with reference to a flowchart shown in FIG. 5. First, the lower heat radiation element 48 (see FIG. 4) is prepared and positioned with its mount plate portion 48*b* oriented upward in step S101. Subsequently, the lower insulation film 52 is placed on the lower heat radiation element 48 (more specifically, on the mount plate portion 48*b*) so as to be overlapped therewith in step S102. Thereafter, the heat generation element 50 is placed on the lower insulation film 52 in step S103. The terminals 51 may be attached to the heat generation element 50 before performing step S103. The upper insulation film 52 is placed on the lower insulation film 52 (having the heat generation element 50 placed thereon) so as to be overlapped therewith in step S104, so that the heat generation element 50 is positioned between the upper and lower insulation films 52. Subsequently, with the mount plate portion 48*b* oriented downward, the upper heat radiation element 48 is placed on the upper insulation film 52 so as to be overlapped therewith in surface-to-surface contact relationship in step S105.

Subsequently, in step S106, the heat radiation elements 48 are hot-pressed together with the heat generation element 50 and the insulation films 52 positioned between the heat radiation elements 48. By the heat and pressure applied during the hot-press operation, the insulation films 52 are melted and adhered to each other throughout their surface areas, and at the same time, the melted insulation films 52 are adhered to the radiation elements 48, so that each of the heat radiation elements 48 is adhered to the heat generation element 50 via the corresponding insulation film 52 throughout the entire surface area. The insulation films 52 may be solidified, for example, by way of a drying process or a cooling process, so that the insulation films 52 are bonded to each other and also bonded to the radiation elements 48. Consequently, the heat generation unit 46 having the heat generation element 50 and the insulation films 52 can be completed, and at the some time, the heating device 45 having the heat generation unit 46 and the heat radiation elements 48 integrated together can be completed (see FIG. 3).

Referring back to FIGS. 1 and 2, the heating device 45 manufactured by the method described above may be disposed within the primary adsorption chamber 17 (more specifically within a space defined between the front filter 36 and the rear filter 37 positioned on opposite sides of the primary adsorption chamber 17). Preferably, the heating device 45 is positioned such that the extending direction of the gas passages 49 of the heat radiation elements 48 is the same as the direction of flow of gas through the primary adsorption chamber 17 (i.e., the forward and rearward direction) (see FIG. 1). In addition, the heat radiation elements 48 may be oriented upward and downward, respectively, within the primary adsorption chamber 17 (see FIG. 2). The adsorption material 42 may be filled into the space defined between the front filter 36 and the rear filter 37 of the primary adsorption chamber 17. Therefore, the adsorption material 42 may be filled into the gas passages 49 of the heat radiation elements 48.

As shown in FIG. 1, a connector 54 may be disposed at the front end wall of the case body 13, for example, at a position between the tank port 22 and the purge port 3. The connector 54 may include a connector body integrated with the front end wall and a pair of terminals 55 extending between inside and outside of the case body 13 through the connector body. The terminals 55 are electrically connected to the terminals 51 of the heat generation element 50 of the heat generation unit 46 (see FIG. 4) via lead wires 56. An external connector connected to the ECU (not shown) may be connected to the connector 54, no that terminals of the external connector may be connected to the terminals 55 of the connector 54. Therefore, the ECU may control the supply of electric power to the heat generation element 50.

A fuel vapor processing system incorporating the fuel vapor processing apparatus 10 will now be described with reference to FIG. 1. The fuel vapor processing system may include the fuel vapor processing apparatus 10, the fuel vapor passage 26, the purge passage 30, the purge valve 34 and the ECU.

In the state where the engine 31 of the vehicle is stopped, the purge valve 34 may be closed. Therefore, fuel vapor produced within the fuel tank 27 may be introduced into the primary adsorption chamber 33 via the fuel vapor passage 26. Then, the adsorption material 42 filled within the adsorption chamber 17 may adsorb the fuel vapor. If the fuel vapor has not been completely adsorbed by the adsorption material 42 of the primary adsorption chamber 17, the remaining fuel vapor may flow into the secondary adsorption chamber 18 via the communication passage 20 and may be adsorbed by the adsorption material 42 contained in the secondary adsorption chamber 18.

On the other hand, during driving of the engine 31, the purge valve 34 may be opened, so that a negative pressure of intake air may be applied to inside of the fuel vapor processing apparatus 10. In association with this, the atmospheric air (fresh air) may be introduced into the secondary adsorption chamber 18 via the atmospheric port 24. The air introduced into the secondary adsorption chamber 18 may desorb fuel vapor from the adsorption material 42 of the secondary adsorption chamber 18 and may then be introduced into the primary adsorption chamber 17 via the communication passage 20, so that fuel vapor may be desorbed from the adsorption material 42 of the primary adsorption chamber 17. Thereafter, the air containing the desorbed fuel vapor may be discharge or purged into the intake pipe 32, no that the fuel vapor may be burned within the engine 31. During desorption of fuel vapor from the adsorption materials 42, an electric power may be supplied to the heat generation element 50 of the heat generation unit 46 of the heating device 45 (see FIG. 4) under the control of the ECU. Then, the heat generation element 50 may generate heat that is radiated through the heat radiation elements 48. Therefore, it is possible to inhibit decrease in temperature of the adsorption material 42 of the primary adsorption chamber 17 during desorption of fuel vapor. Hence, it is possible to improve the desorption efficiency.

With the heating device 45 (see FIGS. 3 and 4) used for the fuel vapor processing apparatus 10, the insulation films 52 provided between the heat generation element 50 and the heat radiation elements 48 may have a function for insulative protection of the heat generation element 50 and may also have a function of bonding the heat radiation elements 48 to the heat generation element 50. Therefore, the heat radiation elements 48 may be positioned so as to closely contact with the heat generation element 50 via the insulation films 52. Hence, it is possible to reduce loss of heat conducted from the heat generation element 50 to the heat radiation elements 48 via the insulation films 52, so that the conductivity of heat from the heat generation element 50 to the heat radiation elements 48 can be improved. In addition, it is not necessary to use a special adhesive material for bonding the heat radiation elements 48 to the heat generation element 50. Therefore, it is possible to simplify the process necessary for insulation between the heat generation element 50 and each of the heat radiation elements 48 and for boding them together. Hence, it is possible to manufacture the heating device 45 at a lower cost.

The fuel vapor processing apparatus 10 includes the heating device 45 that can reduce loss of heat and can improve the heat conductivity as described above. During desorption of fuel vapor from the adsorption material 42, an electric power may be supplied to the heat generation element 50 of the heating device 45 to generate heat that may be radiated from the heat radiation elements 48, so that decrease in temperature of the adsorption material 42 may be inhibited to improve the desorption efficiency. In addition, the heating device 45 may contribute to improve the responsiveness in terms of heating of the adsorption material 42 and to homogenization of temperature distribution within the primary adsorption chamber 17. This may enable to ensure a sufficient fuel desorption amount even in the case that a purge amount of fuel into the engine is relatively small. Therefore, the fuel vapor processing apparatus 10 can be advantageously used for a vehicle, such as a hybrid electric vehicle (HEV) that is relatively short in an operating time of its engine.

Further, the heating device 45 is positioned such that the direction of flow of gas through the heat radiation elements 48 (i.e., the extending direction of the gas passages 49) is the same as the direction of flow of gas through the primary adsorption chamber 17. Therefore, gas can smoothly flow through the gas passages 49 of the heat radiation elements 48. In addition, gas may flow through the gas passages 49 at a substantially uniform flow rate throughout the gas passages 49.

Second to fifth embodiments will now be described with reference to FIGS. 6 to 16. These embodiments are modifications of the first embodiment. Therefore, in FIGS. 6 and 16, like members are given the same reference signs as the first embodiment and the description of these elements will not be repeated.

Figure 6:
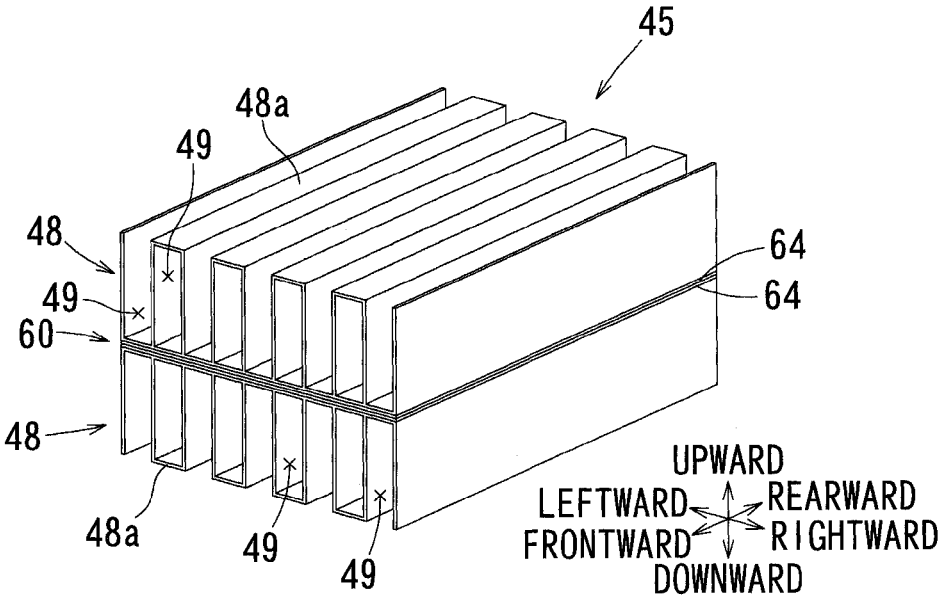
FIG. 6 is a perspective view of a heating device according to a second embodiment.
Figure 7:
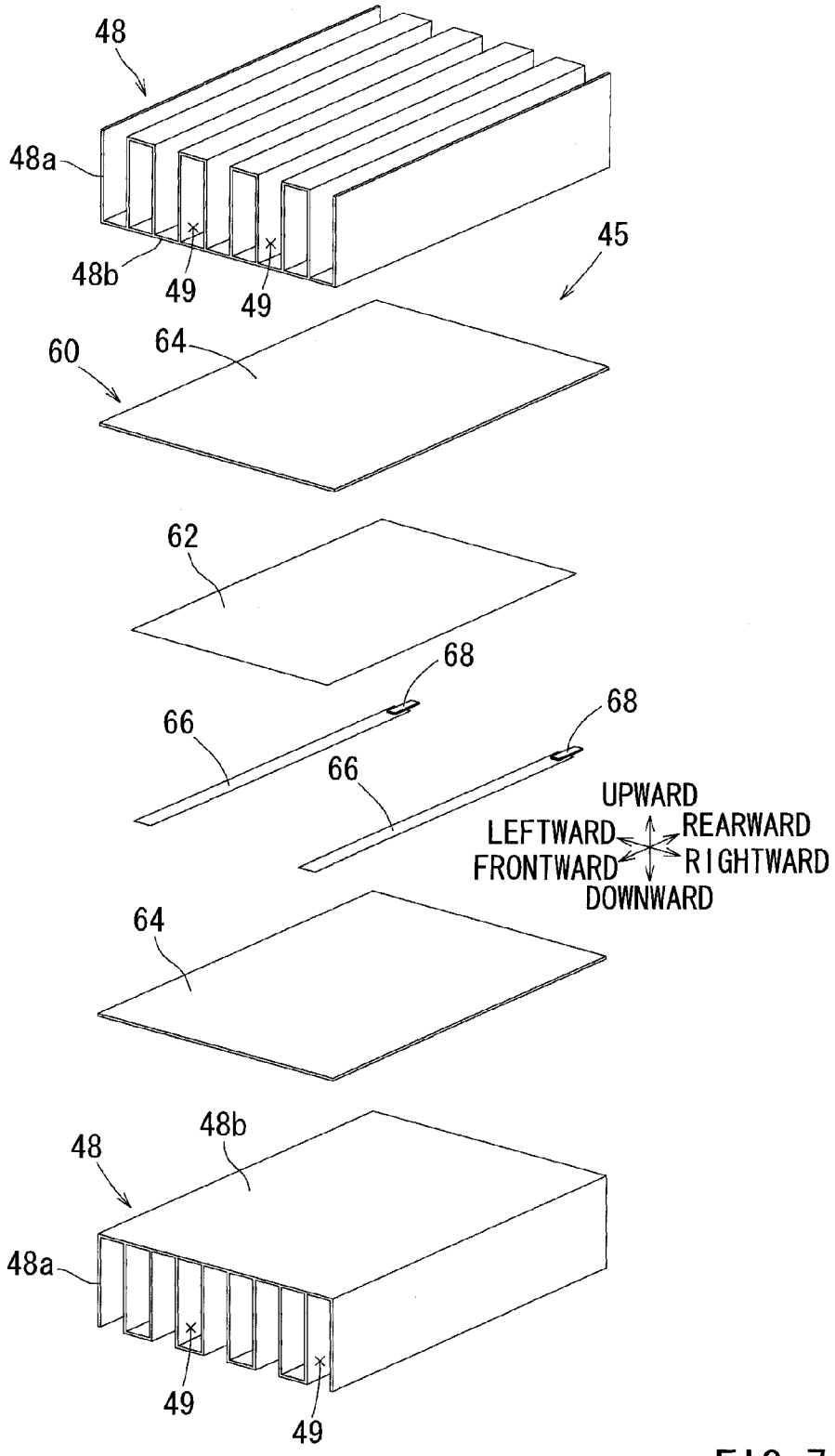
FIG. 7 is an exploded perspective view of the heating device of the second embodiment.

The second embodiment will be described with reference to FIGS. 6 to 9. As shown in FIGS. 6 and 7, the heating device 45 of the second embodiment is different from the heating device 45 of the first embodiment in that the heat generation unit 46 (see FIGS. 1 and 2) is replaced with a heat generation unit 60 that may be formed by using a printing process.

Figure 8:
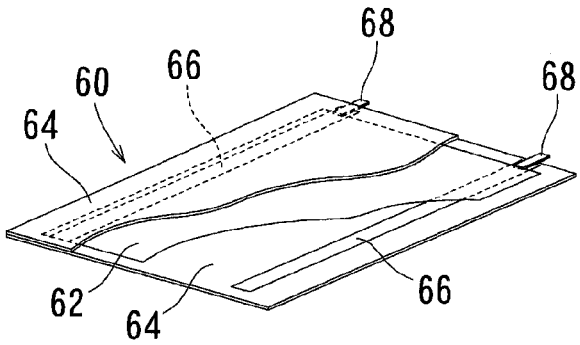
FIG. 8 is a perspective view of a heat generation unit of the heating device of the second embodiment with a part broken away.

Referring to FIG. 7, the heat generation unit 60 may include a heat generation layer 62 and a pair of upper and lower insulation layers 64 (see FIG. 8). The heat generation layer 62 can generate heat by receiving a supply of an electric power. Thus, the heat generation layer 62 may serve as a heat generation element. The upper and lower insulation layers 64 are disposed on opposite sides of the heat generation layer 62 and each has an electrical insulation property. The heat generation layer 62 may be formed of a printed layer. Print ink used for the heat generation layer 62 may be thermosetting-type heat generation ink and may contain electrically conductive resin and carbon mixed therewith. Each of the upper and lower insulation layers 64 also may be formed of a printed layer. However, print ink used for the insulation layers 64 may be thermosetting-type or light curing-type insulation ink and may contain polyimide-based resin. Between the heat generation layer 62 and one of the insulation layers 64, such as the lower insulation layer 64, left and right electrode layers 66 are disposed to extend in the forward and rearward direction. Also, each of the left and right electrode layers 66 may be formed of a printed layer. Print ink used for the electrode layers 66 may be thermosetting-type electrode ink and may contain electrically conductive resin and silver mixed therewith. A terminal 68 may be attached to one end, such as a rear end, of each electrode layer 66.

Figure 9:
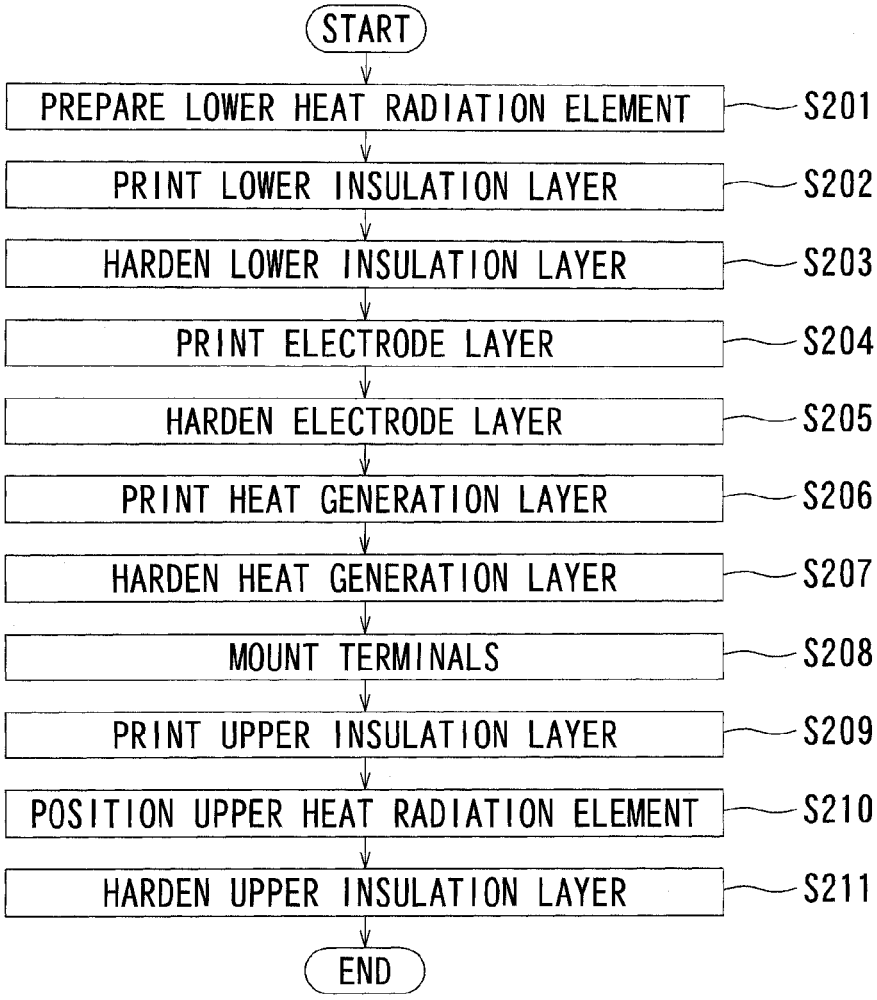
FIG. 9 is a flow chart showing a manufacturing process of the heating device of the second embodiment.

A representative example of a method of manufacturing the heating device 45 having the heat generation unit 60 will now be described with reference to a flowchart shown in FIG. 9. First, the lower heat radiation element 48 (see FIG. 7) is prepared and positioned with its mount plate portion 48*b* oriented upward in step S201. Subsequently, the lower insulation layer 64 is printed on the lower heat radiation element 48 (more specifically, its mount plate portion 48*b*) so as to be overlapped therewith in step S202. Thereafter, the lower insulation layer 64 is hardened or cured in step S203, so that the lower insulation layer 64 is bonded to the lower heat radiation element 48. Subsequently, the electrode layers 66 are printed on the upper surface of the lower insulation layer 66 in step S204 and are thereafter hardened or cured in step S205. Therefore, the electrode layers 66 are bonded to the lower insulation layer 64.

Next, in step S206, the heat generation layer 62 is printed on the upper surface of the lower insulation layer 64 having the electrode layers 66 bonded thereto. Thereafter, the heat generation layer 62 is hardened or cured in step S207, so that the heat generation layer 62 is bonded to the lower insulation layer 64 and also to the electrode layers 66. Then, in step S208, the terminals 68 are attached to the electrode layers 66. Subsequently, the upper insulation layer 64 is printed on the heat generation layer 62 in step S209. Thereafter, the upper heat radiation element 48 is placed on the upper surface of the upper insulation layer 64 so as to be overlapped therewith in step S210, so that the mount plate portion 48*b* oriented downward is overlapped with the upper insulation layer 64 in surface-to-surface contact relationship therewith. Thereafter, the upper insulation layer 64 is hardened or cured in step S211, so that the upper heat radiation element 48 is bonded to the upper insulation layer 64. Consequently, the heat generation unit 60 having the heat generation element 50 and the insulation layers 64 can be completed, and at the same time, the heating device 45 having the heat generation unit 60 and the heat radiation elements 48 integrated together can be completed (see FIG. 6). The printing step of each of the heat generation layer 62, the insulation layers 64 and the electrode layers 66 can be made by using a screen-printing technique, an ink jet printing technique or any other suitable technique.

According to this embodiment, the heat generation layer 62 of the heat generation unit 60 is formed of a printed layer. Therefore, it is possible to reduce the thickness of the heat generation layer 62. In addition, the heat generation layer 62 may further closely contact with the insulation layers 64, so that the conductivity of heat from the heat generation layer 62 to the heat radiation elements 48 can be further improved.

In addition, each of the insulation layers 64 of the heat generation unit 60 is also formed of a printed layer. Therefore, it is possible to reduce the thickness of each of the insulation layers 64. In addition, due to reduction in thickness of the insulation layers 64, it is possible to improve the conductivity of heat from the heat generation layer 62 to the heat radiation elements 48.

Further, each of the electrode layers 66 of the heat generation unit 60 is also formed of a printed layer. Therefore, it is possible to reduce the thickness of each of the electrode layers 66.

Preferably, at least the heat generation layer 62, and/or at least the insulation layers 64 and/or at least the electrode layers 66 of the heat generation unit 60 may be formed by using a screen printing technique, so that it is possible to reduce the manufacturing cost. In addition, at least one of the heat generation layer 62, the insulation layers 64 and the electrode layers 66 may be made of a sheet-like element that is not formed by using a printing technique. For example, the heat generation layer 62 may be replaced with the heat generation element 50 of the first embodiment (see FIG. 4). Additionally or alternatively, the electrode layers 66 may be replaced with sheet-like electrodes.

Figure 10:
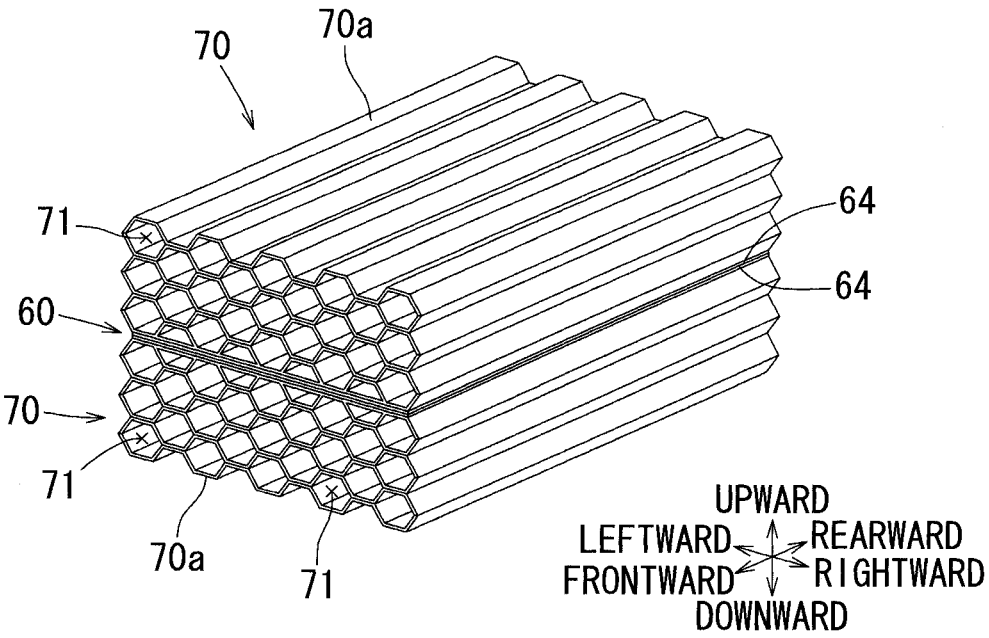
FIG. 10 is a perspective view of a heating device according to a third embodiment.
Figure 11:
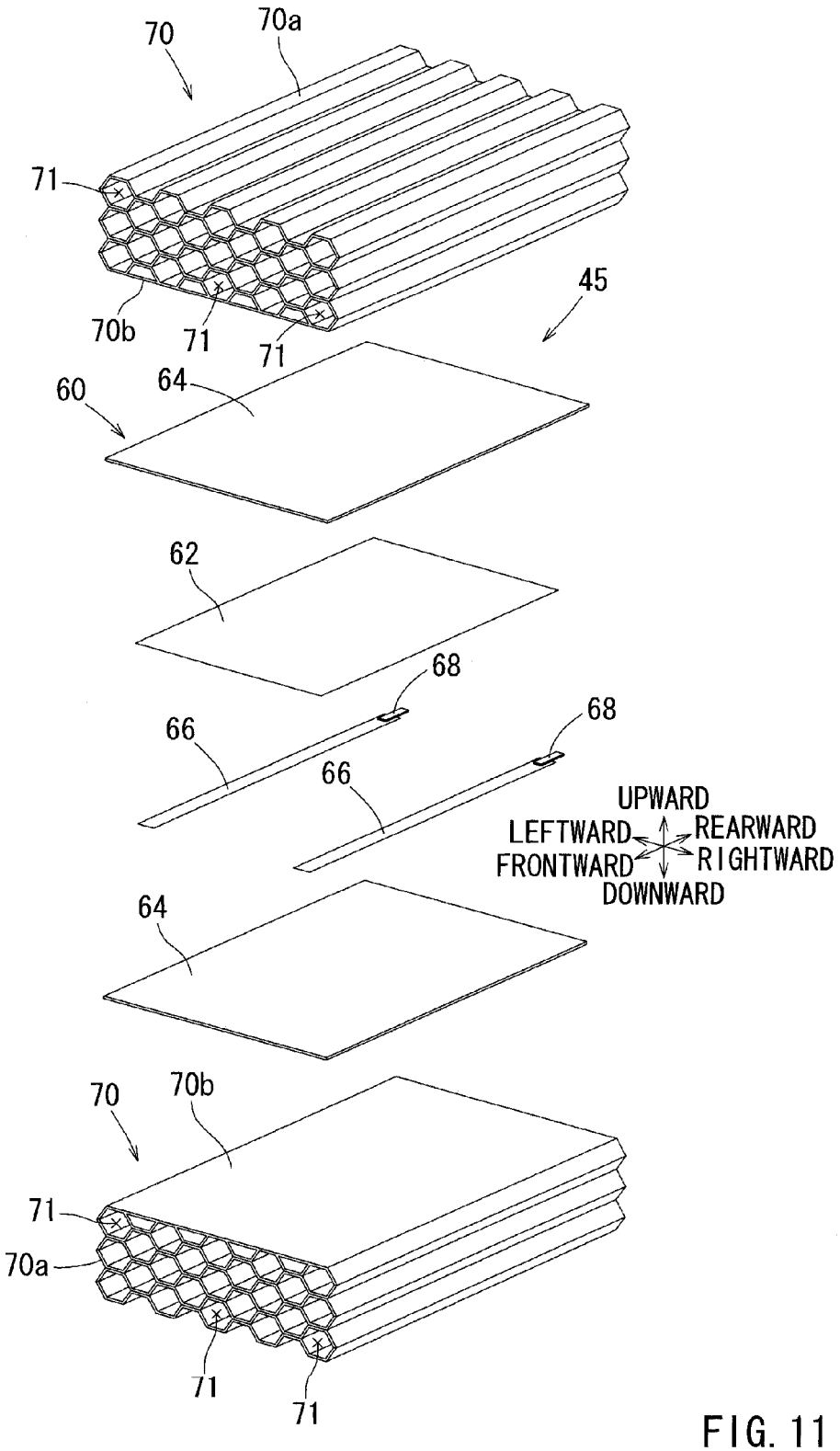
FIG. 11 is an exploded perspective view of the heating device of the third embodiment.

A third embodiment will now be described with reference to FIGS. 10 and 11. The third embodiment is a modification of the second embodiment and is different from the second embodiment in that the heat radiation elements 48 of the heating device 45 (see FIGS. 6 and 7) are replaced with heat radiation elements 70 each having a honeycomb structure. More specifically, each of the heat radiation elements 70 includes a honeycomb fin 70*a* having a honeycomb structure as a main component. A flat mount plate portion 70*b* is formed on one side of the honeycomb fin 70*a* facing to the heat generation unit 60 (see FIG. 11). A plurality of gas passages 71 are formed in the honeycomb fin 70*a* to extend therethrough in the forward and rearward direction. Each of the gas passages 71 has a hexagonal cross section and surrounded by six cell walls that extend in series with each other in the circumferential direction.

According to the heating device 45 of the third embodiment, each of the heat radiation elements 70 includes die honeycomb fin 70*a* as a main component. Therefore, the heat radiation elements 70 may have large heat radiation areas, so that heat from the heat generation layer 62 can be effectively radiated from the heat radiation elements 70.

Figure 12:
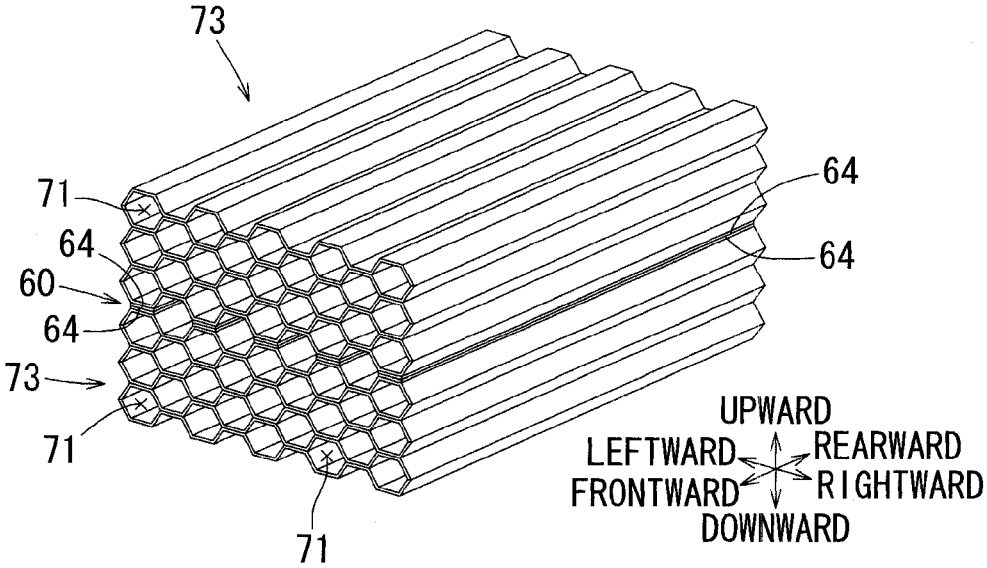
FIG. 12 is a perspective view of a heating device according to a fourth embodiment.
Figure 13:
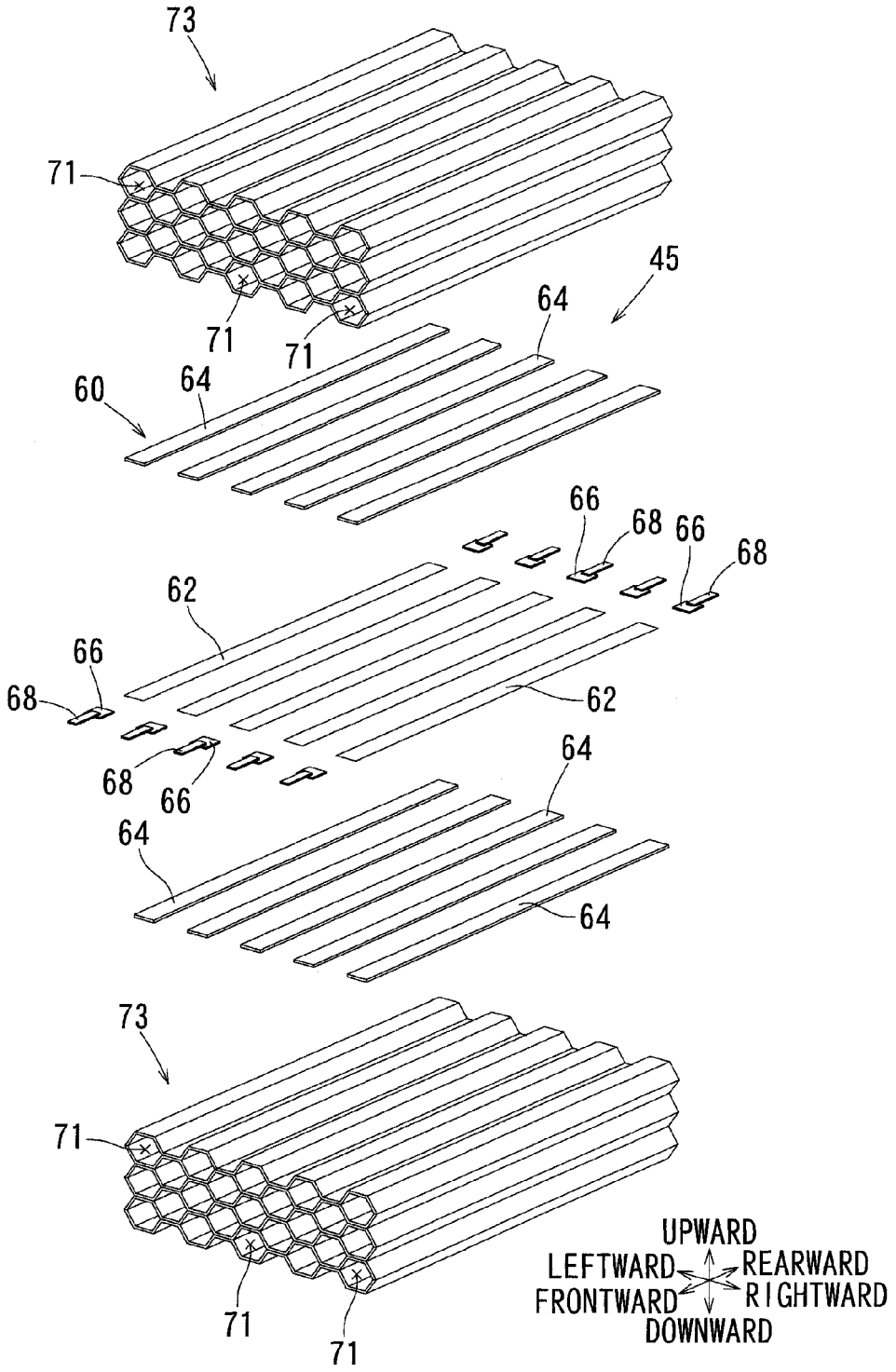
FIG. 13 is an exploded perspective view of the heating device of the fourth embodiment.

A fourth embodiment will now be described with reference to FIGS. 12 and 13. The fourth embodiment is a modification of the third embodiment and is different from the third embodiment in that the heat radiation elements 70 are replaced with heat radiation elements 73. Each of the heat radiation elements 73 is different from the heat radiation element 70 in that the mount plate portion 70*b* of the honeycomb fin 70*a* of the heat radiation element 70 (see FIG. 11) is omitted. Therefore, a mount surface of each heat radiation element 73 for bonding to the heating unit 60 is formed by a plurality of cell walls arranged parallel to each other in the left and right direction and elongated in the forward and rearward direction. In this connection, the heat generation layer 62, the heat insulation layers 64, the electrode layers 66 and the terminals 68 are configured to correspond to the configuration of the mount surface of the heat radiation elements 73. More specifically, each of the heat generation layer 62 and the insulation layers 64 may be divided into a plurality of elongated portions corresponding to the cell walls of the heat radiation element 73. In addition, each of the electrode layers 66 is divided into a plurality of portions each positioned at opposite ends of each of the elongated portions of the heat generation layer 62. Each of the terminals 68 is divided into portions each positioned at an outer end of each of the portions of the corresponding electrode layer 66.

A fifth embodiment will now be described with reference to FIGS. 14 to 16. Also, the fifth embodiment is a modification of the third embodiment and is different from the third embodiment in that the heat radiation elements 70 (see FIGS. 10 and 11) are replaced with heat radiation elements 75. Each of the heat radiation elements 7 can be folded and unfolded as will be hereinafter explained.

Figure 14:
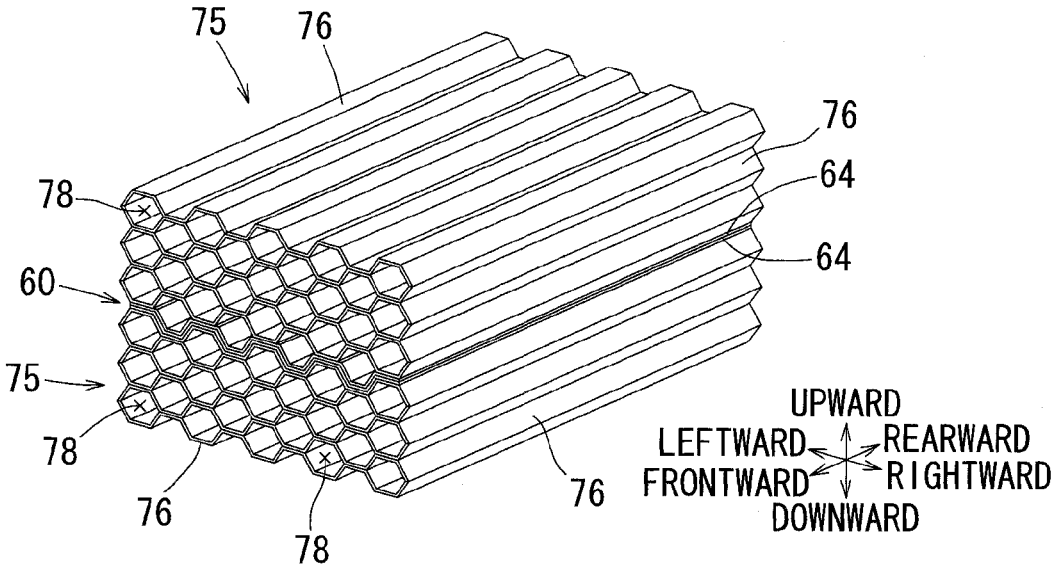
FIG. 14 is a perspective view of a heating device according to a fifth embodiment showing heat radiation elements in an unfolded state.

As shown in FIG. 14, each of the heat radiation elements 75 includes a plurality of metal foils 76 that form a plurality of honeycomb cell walls. More specifically, the heat radiation element 75 includes a plurality of gas passages 78 each having a hexagonal cross section and surrounded by six cell walls that extend in series with each other in the circumferential direction. As shown in FIG. 15, the metal foils 76 (six metal foils 76 are used in this embodiment) are stacked into plural layers and joined to each other at joint portions 79 to form a layered structure 80. The joint portions 79 extend in the forward and rearward direction so as to be parallel to each other. More specifically, the positions of the joint portions 79 in the left and right direction are determined such that the joint portions 79 positioned at the same stage between two vertically adjacent layers are spaced from each other at a regular interval but are offset in the left and right direction from those positioned at the next upper stage and/or the next lower stage, so that the layered structure 80 can be unfolded to form the heating element 75 shown in FIG. 14. Therefore, the joint portions 79 are positioned in a staggered pattern along the layered direction of the layered structure 80. The distance between two parallel cell walls of each hexagonal cell (i.e., the gas passage 78) may be set to be, for example, between 9.0 mm and 25.4 mm, and the thickness of each metal foil 76 may be set to be between 6 μm and 200 μm, preferably between 10 μm and 100 μm.

Figure 15:
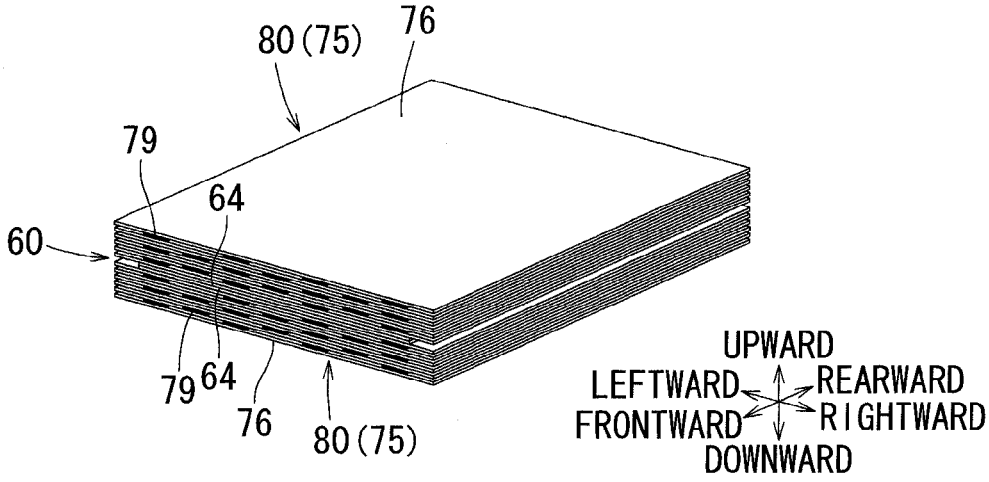
FIG. 15 is a perspective view of the heating device according to the fifth embodiment showing the heat radiation elements in a folded state.
Figure 16:
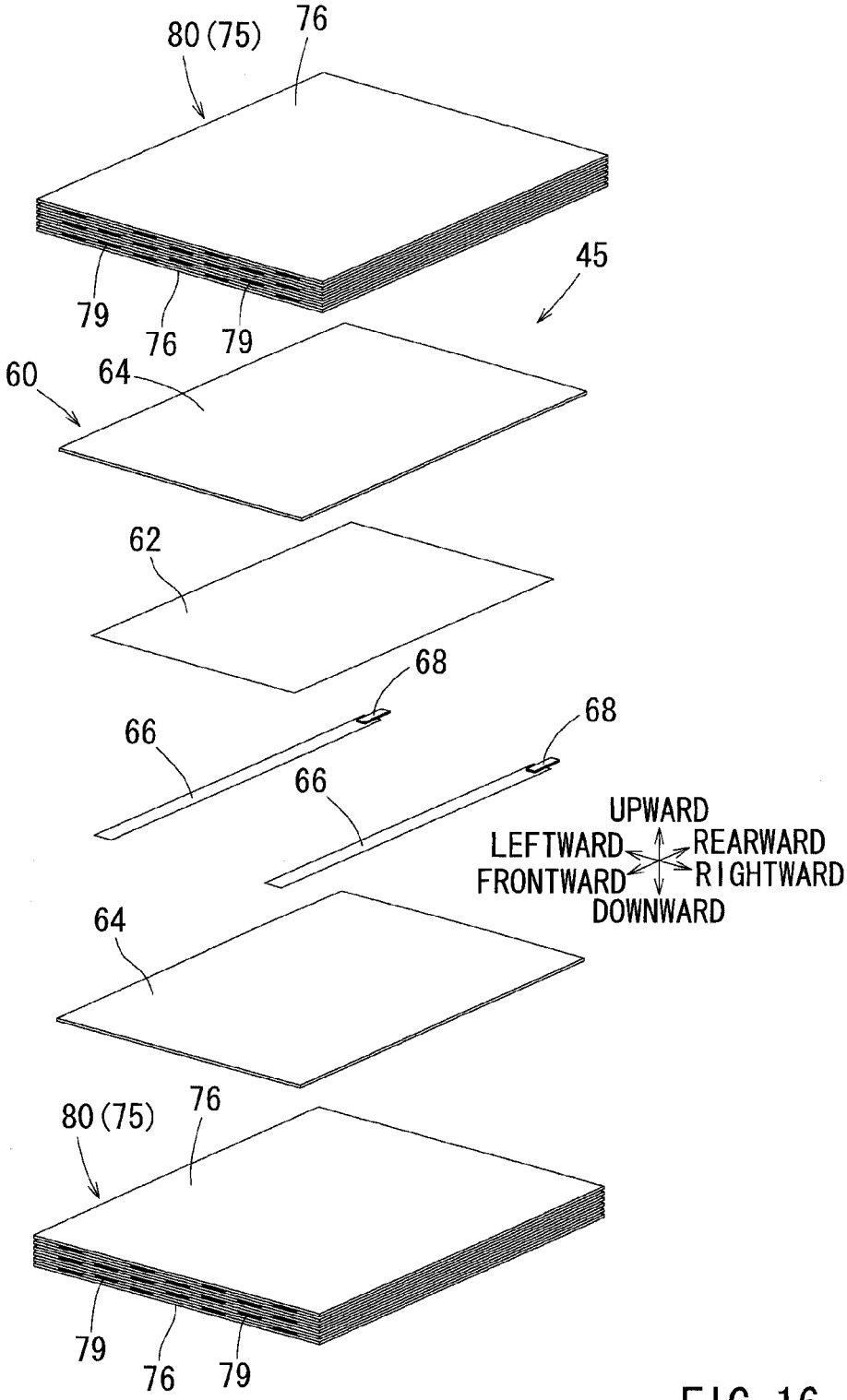
FIG. 16 is an exploded perspective view of the heating device of the fifth embodiment showing the heat radiation elements in the folded state.

The heat radiation elements 75 may be bonded to the heat generation layer 62 of the heat generation unit 60 via the insulation layers 64 in the state that the heat radiation elements 76 are folded into the layered structures 80 (see FIGS. 15 and 16). More specifically, one of the metal foils 76 of the layered structure 80, which defines a mount surface for bonding to the heat generation layer 62, is entirely bonded to the heat generation layer 62 via the corresponding insulation layer 64. Each of the layered structures 80 on opposite sides may be unfolded into a predetermined shape of the heat radiation element 75 (see FIG. 14) before the heating device 45 is assembled into the fuel vapor processing apparatus 10.

According to the heating device 45 of this embodiment, each of the heat radiation elements 75 is configured to have a honeycomb structure including cell walls formed by the metal foils 76. Because the metal foils 76 may have a thickness thinner than typical thin plates, the heat radiation elements 75 may be lightweight. In addition, the heat radiation elements 75 may be bonded to the heat generation layer 62 via the insulation layers 64 in the state that the heat radiation elements 75 are in forms of the layered structures 80 (i.e., the folded state). Therefore, the heat radiation elements 75 can be easily handled before and after they are bonded to the heat generation layer 62 (see FIG. 15). Further, before the heating device 45 is assembled into the fuel vapor processing apparatus 10, the heating device 45 can be handled in the state that the heat radiation elements 75 are in forms of the layered structures 80 (see FIG. 16). In other words, the heating device 45 may be compact in size before it is assembled. Thus, the layered structures 80 may be unfolded in the layered direction into the predetermined shape of the heat radiation elements 75 (see FIG. 14) when the heating device 45 is necessary to be assembled.

The above embodiments may be further modified in various ways. For example, a heating device similar to the heating device 45 may be disposed within the secondary adsorption chamber 18 of the fuel vapor processing apparatus 10. Some of granules of the adsorption material 42 may be attached to the outer circumferential surface of each of the heat radiation elements and may be attached to also the inner circumferential surface of each of the gas passages of the heat radiation elements. The number of the adsorption chambers of the fuel vapor processing apparatus 10 may not be limited to two but may be one or three or more. The cross sectional configuration of the gas passages may not be limited to a rectangular configuration or a hexagonal configuration and may be any other polygonal configuration. Further, although the heat radiation elements are disposed on opposite sides of the heat generation unit in each embodiment, it may be possible that the heating device includes only one heat radiation element disposed on one of opposite sides of the heat generation unit.

What is claimed is:

1. A heating device comprising:

a heat generation unit including a heat generation element, a first insulation layer and a second insulation layer, the heat generation element having a first surface and a second surface opposite to the first surface and being capable of generating heat by receiving a supply of an electric power, the first insulation layer and the second insulation layer being disposed at the first surface and the second surface of the heat generation element, respectively;

wherein the heat generation unit has a first side on the side of the first surface of the heat generation element and has a second side and on the side of the second surface of the heat generation element; and a first heat radiation element disposed on the first side of the heat generation unit, so that the first insulation layer is positioned between the heat generation element and the first heat radiation element;

wherein the first insulation layer is configured to provide electrical insulative protection of the heat generation element and is bonded to both of the heat generation element and the first heat radiation element; and wherein at least one of the first and second heat insulation layers is formed of a printed layer.

2. The heating device according to claim 1, further comprising a second heat radiation element disposed on the second side of the heat generation unit, so that the second insulation layer is positioned between the heat generation element and the second heat radiation element;

wherein the second insulation layer is configured to provide electrical insulative protection of the heat generation element and is bonded to both of the heat generation element and the second heat radiation element.

3. The heating device according to claim 1, wherein the heat generation element is formed of a printed layer.

4. The heating device according to claim 1, wherein each of the first and second heat insulation layers is formed of a printed layer.

5. The heating device according to claim 1, wherein the first heat radiation element has a honeycomb structure.

6. The heating device according to claim 2, wherein each of the first and second heat radiation elements has a honeycomb structure.

7. The heating device according to claim 5, wherein;

the first heat radiation element comprises a plurality of metal foils stacked in a layered direction to form a layered structure, the plurality of metal foils being joined to each other at joint portions, and the joint portions extending parallel to each other at an interval and arranged in a staggered pattern along the layered direction;

the layered structure is configured to be able to be unfolded in the layered direction to have a predetermined shape; and the first heat radiation element is bonded to the heat generation element via the first insulation layer in the state that the layered structure is not unfolded into the predetermined shape.

8. The heating device according to claim 6, wherein;

each of the first and second heat radiation elements comprises a plurality of metal foils stacked in a layered direction to form a layered structure, the plurality of metal foils being joined to each other at joint portions, and the joint portions extending parallel to each other at an interval and arranged in a staggered pattern along the layered direction;

the layered structure is configured to be able to be unfolded in the layered direction to have a predetermined shape; and the first heat radiation element and the second heat radiation element are bonded to the heat generation element via the first insulation layer and the second insulation layer, respectively, in the state that the layered structure of each of the first and second heat radiation elements is not unfolded into the predetermined shape.

9. A fuel vapor processing apparatus comprising:

a case defining therein an adsorption chamber;

an adsorption material capable of adsorbing fuel vapor and disposed within the adsorption chamber;

wherein the case is configured to be able to introduce air into the adsorption chamber for desorbing fuel vapor from the adsorption material; and a heating device positioned within the adsorption chamber, the heating device comprising:

a heat generation unit including a heat generation element, a first insulation layer and a second insulation layer, the heat generation element having a first surface and a second surface opposite to the first surface and being capable of generating heat by receiving a supply of an electric power, the first insulation layer and the second insulation layer being disposed at the first surface and the second surface of the heat generation element, respectively;

wherein the heat generation unit has a first side on the side of the first surface of the heat generation element and has a second side and on the side of the second surface of the heat generation element; and a first heat radiation element disposed on the first side of the heat generation unit, so that the first insulation layer is positioned between the heat generation element and the first heat radiation element;

wherein the first insulation layer is configured to provide insulative protection of the heat generation element and is bonded to both of the heat generation element and the first heat radiation element; and wherein at least one of the first and second heat insulation layers is formed of a printed layer.

10. A heating device comprising:

an electric heating element configured to generate heat;

a heat radiation element; and an electrical insulation member interposed between the electric heating element and the heat radiation element;

wherein:

the electrical insulation member is bonded to both of the electric heating element and the heat radiation element;

the heat radiation element comprises a plurality of metal foils stacked in a layered direction to form a layered structure, the plurality of metal foils being joined to each other at joint portions, and the joint portions extending parallel to each other at an interval and arranged in a staggered pattern along the layered direction; and the layered structure is configured to be able to be unfolded in the layered direction to form a honeycomb structure.

11. The heating device as in claim 10, wherein the electrical insulation layer is made of thermoplastic resin.

12. The heating device according to claim 11, wherein the thermoplastic resin includes polyimide resin.

13. The heating device according to claim 11, wherein the electrical insulation member is formed of a film made of the thermoplastic resin.

14. The heating device according to claim 10, wherein the electrical insulation member is made of thermosetting resin.

15. The heating device according to claim 14, wherein the electrical insulation member is formed of a printed layer with print ink containing the thermosetting resin.

16. The heating device according to claim 10, wherein the electrical insulation member is made of light-curing resin.

17. The heating device according to claim 16, wherein the electrical insulation member is formed of a printed layer with print ink containing the light-curing resin.

18. A fuel vapor processing apparatus comprising:

a case defining therein an adsorption chamber;

an adsorption material capable of adsorbing fuel vapor and disposed within the adsorption chamber;

wherein the case is configured to be able to introduce air into the adsorption chamber for desorbing fuel vapor from the adsorption material; and a heating device positioned within the adsorption chamber;

wherein the heating device comprises:

an electric heating element configured to generate heat;

a heat radiation element; and an electrical insulation member interposed between the electric heating element and the heat radiation element;

wherein:

the electrical insulation member is bonded to both of the electric heating element and the heat radiation element;

the heat radiation element comprises a plurality of metal foils stacked in a layered direction to form a layered structure, the plurality of metal foils being joined to each other at joint portions, and the joint portions extending parallel to each other at an interval and arranged in a staggered pattern along the layered direction; and the layered structure is configured to be able to be unfolded in the layered direction to form a honeycomb structure.

19. A heating device comprising:

a heat generation unit including a heat generation element, a first insulation layer and a second insulation layer, the heat generation element having a first surface and a second surface opposite to the first surface and being capable of generating heat by receiving a supply of an electric power, the first insulation layer and the second insulation layer being disposed at the first surface and the second surface of the heat generation element, respectively;

wherein the heat generation unit has a first side on the side of the first surface of the heat generation element and has a second side and on the side of the second surface of the heat generation element; and a heat radiation element disposed on the first side of the heat generation unit, so that the first insulation layer is positioned between the heat generation element and the first heat radiation element;

wherein the first insulation layer is configured to provide electrical insulative protection of the heat generation element and is bonded to both of the heat generation element and the heat radiation element;

wherein the heat radiation element comprises a plurality of metal foils stacked in a layered direction to form a layered structure, the plurality of metal foils being joined to each other at joint portions, and the joint portions extending parallel to each other at an interval and arranged in a staggered pattern along the layered direction; and wherein the layered structure is configured to be able to be unfolded in the layered direction to form a honeycomb structure.

20. A fuel vapor processing apparatus comprising:

a case defining therein an adsorption chamber;

an adsorption material capable of adsorbing fuel vapor and disposed within the adsorption chamber;

wherein the case is configured to be able to introduce air into the adsorption chamber for desorbing fuel vapor from the adsorption material; and a heating device positioned within the adsorption chamber, the heating device comprising:

a heat generation unit including a heat generation element, a first insulation layer and a second insulation layer, the heat generation element having a first surface and a second surface opposite to the first surface and being capable of generating heat by receiving a supply of an electric power, the first insulation layer and the second insulation layer being disposed at the first surface and the second surface of the heat generation element, respectively;

wherein the heat generation unit has a first side on the side of the first surface of the heat generation element and has a second side and on the side of the second surface of the heat generation element; and a first heat radiation element disposed on the first side of the heat generation unit, so that the first insulation layer is positioned between the heat generation element and the first heat radiation element;

wherein the first insulation layer is configured to provide insulative protection of the heat generation element and is bonded to both of the heat generation element and the first heat radiation element;

wherein the heat radiation element comprises a plurality of metal foils stacked in a layered direction to form a layered structure, the plurality of metal foils being joined to each other at joint portions, and the joint portions extending parallel to each other at an interval and arranged in a staggered pattern along the layered direction; and wherein the layered structure is configured to be able to be unfolded in the layered direction to form a honeycomb structure.

* * * * *